US011337522B2

(12) United States Patent
Cao

(10) Patent No.: US 11,337,522 B2
(45) Date of Patent: May 24, 2022

(54) STORAGE MESH PLATE HAVING REINFORCED PROTECTION AND DECORATION FUNCTION

(71) Applicant: Guohua Cao, Guangdong (CN)

(72) Inventor: Guohua Cao, Guangdong (CN)

( * ) Notice: Subject to any disclaimer, the term of this patent is extended or adjusted under 35 U.S.C. 154(b) by 28 days.

(21) Appl. No.: 16/991,036

(22) Filed: Aug. 12, 2020

(65) Prior Publication Data

US 2022/0022649 A1 Jan. 27, 2022

(30) Foreign Application Priority Data

Jul. 27, 2020 (CN) ..... 202021500971.X

(51) Int. Cl.
*A47B 96/02* (2006.01)
*A47B 96/20* (2006.01)
*A47B 95/04* (2006.01)

(52) U.S. Cl.
CPC ..... *A47B 96/021* (2013.01); *A47B 95/043* (2013.01); *A47B 96/201* (2013.01); *A47B 96/205* (2013.01)

(58) Field of Classification Search
CPC ..... A47B 96/021; A47B 96/205; A47B 55/02; A47B 96/201; A47B 95/043; E06B 5/006
See application file for complete search history.

(56) References Cited

U.S. PATENT DOCUMENTS 2,913,128 A * 11/1959 Milner ..... A47B 55/02 108/181
3,047,142 A * 7/1962 Heffley ..... B65D 81/055 217/69
3,065,860 A * 11/1962 Swanson ..... A47B 96/021 211/153
3,424,111 A * 1/1969 Maslow ..... A47B 57/265 108/147.13
3,664,274 A * 5/1972 Bustos ..... A47B 57/265 108/147.13
3,675,598 A * 7/1972 Kesilman ..... A47B 57/26 108/147.13
3,874,511 A * 4/1975 Maslow ..... A47B 96/021 211/153
3,915,101 A * 10/1975 Onori ..... A47B 57/265 108/192

(Continued)

FOREIGN PATENT DOCUMENTS

DE 4211001 C1 * 12/1992 ..... A47B 96/021
DE 202012012735 U1 * 10/2013 ..... A47F 11/10

(Continued)

*Primary Examiner* — Stanton L Krycinski

(57) ABSTRACT

A storage mesh plate, which includes a first long frame, a second long frame and a mesh plate, one end of the first long frame and one end of the second long frame are provided with a first short frame, and another end of the first long frame and another end of the second long frame are provided with a second short frame; four corners where the first long frame is connected to the first short frame and the second short frame and the second long frame is connected to the first short frame and the second short frame are provided with a first reinforced protection decorating part, a fourth reinforced protection decorating part, a second reinforced protection decorating part and a third reinforced protection decorating part respectively.

8 Claims, 10 Drawing Sheets

(56) References Cited

U.S. PATENT DOCUMENTS 3,964,404 A * 6/1976 Mueller ..... F16B 2/065 108/147.14
4,138,953 A * 2/1979 Tashman ..... A47B 57/265 108/147.13
4,257,333 A * 3/1981 Pollack ..... A47B 57/265 108/147.13
4,750,626 A * 6/1988 Nicely ..... A47B 57/265 108/192
4,754,712 A * 7/1988 Olson ..... A47B 57/265 108/107
4,811,670 A * 3/1989 Kolvites ..... A47B 57/265 108/107
4,852,501 A * 8/1989 Olson ..... A47B 57/265 108/107
5,002,247 A * 3/1991 Dispenza ..... A47B 13/021 108/147.14
5,415,302 A * 5/1995 Carlson ..... A47B 55/02 108/147.13
5,441,162 A * 8/1995 Niblock ..... A47B 55/02 211/153
5,709,158 A * 1/1998 Wareheim ..... A47B 87/0246 108/180
5,913,501 A * 6/1999 Heuss ..... A47B 96/021 248/346.07
5,964,163 A * 10/1999 Cohen ..... A47B 49/004 108/186
6,725,785 B2 * 4/2004 Wang ..... A47B 13/08 108/90
7,992,730 B2 * 8/2011 Huang ..... A47F 5/01 211/187
8,042,477 B2 * 10/2011 Lee ..... A47B 87/007 108/147.12
8,118,181 B2 * 2/2012 Shinozaki ..... A47B 47/0083 211/187
8,201,796 B2 * 6/2012 Belyea ..... A47B 95/043 206/453
8,826,898 B2 * 9/2014 Armstrong ..... F24C 15/16 126/19 R
9,370,242 B2 * 6/2016 Guizzardi ..... A47B 87/0223
9,418,267 B1 * 8/2016 Josey ..... G06Q 10/08
9,474,374 B2 * 10/2016 Reinhart ..... A47B 87/0223
9,854,906 B1 * 1/2018 Ke ..... A47B 47/0091
10,231,544 B2 * 3/2019 Reinhart ..... A47B 47/045
10,299,590 B2 * 5/2019 Olson ..... A47B 96/021
11,096,486 B1 * 8/2021 Ke ..... A47B 57/34
2006/0243636 A1 * 11/2006 Robichaud ..... B65D 81/056 206/586
2007/0034584 A1 * 2/2007 Park ..... A47B 47/045 211/187
2009/0250572 A1 * 10/2009 Cheng ..... A47F 5/13 248/188.6
2010/0326937 A1 * 12/2010 Lin ..... A47B 96/021 211/135
2016/0120313 A1 * 5/2016 Tang ..... A47B 47/0091 211/134
2020/0100588 A1 * 4/2020 Reinhart ..... A47B 87/008
2020/0154887 A1 * 5/2020 Nilsson ..... A47B 96/02

FOREIGN PATENT DOCUMENTS

EP 0261681 A2 * 3/1988 ..... B29C 70/70
FR 2276796 A1 * 1/1976 ..... A47B 9/08
KR 20080022564 A * 3/2008

* cited by examiner

STORAGE MESH PLATE HAVING REINFORCED PROTECTION AND DECORATION FUNCTION

BACKGROUND OF THE INVENTION

The present invention relates to the technical field of storage mesh plates, and in particular, to a storage mesh plate having a reinforced protection and decoration function.

An existing storage mesh plate is formed mainly by welding frames and panels. As is widely applied, the storage mesh plate can be used as a laminate on a locker to directly serve as a cabinet or a cabinet door panel, or can form a combined shelf together with a bracket. The storage mesh plate has the following shortcomings: four sides of the mesh plate are composed of frames and four corners are sharp, which easily injuries people by collision and has certain potential safety hazards.

BRIEF SUMMARY OF THE INVENTION

An objective of the present invention is to overcome the foregoing shortcomings in the prior art, and provide a storage mesh plate having a reinforced protection and decoration function. The storage mesh plate has four corners wrapped for transition, is elegant in appearance, and does not have sharp corners, thereby eliminating potential safety hazards.

To achieve the foregoing objective, the present invention provides a storage mesh plate having a reinforced protection and decoration function, which includes a first long frame and a second long frame, where a mesh plate is arranged on a middle portion of the first long frame and a middle portion of the second long frame; the first long frame, the second long frame and the mesh plate are integrally formed by stamping and stretching; one end of the first long frame and one end of the second long frame are provided with a first short frame, and the other end of the first long frame and the other end of the second long frame are provided with a second short frame; four corners where the first long frame is connected to the first short frame and the second short frame and the second long frame is connected to the first short frame and the second short frame are provided with a first reinforced protection decorating part, a fourth reinforced protection decorating part, a second reinforced protection decorating part and a third reinforced protection decorating part respectively; the first short frame, the first reinforced protection decorating part and the second reinforced protection decorating part are installed together by welding or integrally formed; and the second short frame, the third reinforced protection decorating part and the fourth reinforced protection decorating part are installed together by welding or integrally formed.

Preferably, a first taper sleeve is further installed at a joint of the first long frame and the first short frame, a second taper sleeve is further installed at a joint of the first short frame and the second long frame, a third taper sleeve is further installed at a joint of the second long frame and the second short frame, a fourth taper sleeve is further installed at a joint of the second short frame and the first long frame, an outer side of the first taper sleeve is coated with the first reinforced protection decorating part, an outer side of the second taper sleeve is coated with the second reinforced protection decorating part, an outer side of the third taper sleeve is coated with the third reinforced protection decorating part, and an outer side of the fourth taper sleeve is coated with the fourth reinforced protection decorating part.

Preferably, surfaces of the first reinforced protection decorating part, the second reinforced protection decorating part, the third reinforced protection decorating part and the fourth reinforced protection decorating part are each provided with a plurality of first protruding points having decorative effects, and upper and lower sides of the first reinforced protection decorating part, the second reinforced protection decorating part, the third reinforced protection decorating part and the fourth reinforced protection decorating part are provided with first stamping convex edges protruding outwards or have no stamping convex edge.

Preferably, upper and lower sides of the first long frame, the second long frame, the first short frame and the second short frame are provided with second stamping convex edges protruding outwards, and side faces of the first long frame, the second long frame, the first short frame and the second short frame are provided with a plurality of second protruding points having decorative effects.

Preferably, the mesh plate is also provided with at least one reinforcing rib, one end of the reinforcing rib is welded to the first long frame, and the other end thereof is welded to the second long frame, or one end of the reinforcing rib 7 is welded to the first short frame 13, the other end thereof is welded to the second short frame 14, and the reinforcing rib is a wire or a pipe.

Preferably, upper and lower surfaces of the first taper sleeve, the second taper sleeve, the third taper sleeve and the fourth taper sleeve are parallel to or higher than those of the first long frame, the second long frame, the first short frame and the second short frame.

Preferably, the first taper sleeve, the second taper sleeve, the third taper sleeve and the fourth taper sleeve are each in a hollow cone frustum shape; and the first taper sleeve, the second taper sleeve, the third taper sleeve and the fourth taper sleeve each have a taper of 5-20°.

Preferably, the mesh plate is a stretched metal mesh plate or a woven metal net, the stretched metal mesh plate or the woven metal net is provided with a plurality of meshes, and the meshes are rhombic or in other polygonal shapes.

Preferably, cross sections of the first long frame, the second long frame, the first short frame and the second short frame are each in an L shape, a P shape or a P shape plus a straight edge.

Compared with the prior art, the present invention has the following beneficial effects:

1. Four corners of the storage mesh plate according to the present invention are provided with reinforced protection decorating parts and coated for transition, and no sharp corner exists, so that potential safety hazards are eliminated, and the storage mesh plate is elegant in appearance. Surfaces of the reinforced protection decorating parts are provided with protruding points. This has antique decorative effects and classical attractiveness, and greatly improves the purchasing desire of consumers.

2. The four corners of the storage mesh plate according to the present invention are provided with taper sleeves, which is beneficial to the assembly and adjustment of the storage mesh plate.

3. The storage mesh plate according to the present invention is provided with first stamping convex edges, second stamping convex edges and reinforcing ribs, which is beneficial to improving the bearing capacity of the storage mesh plate and expands the application range of the storage mesh plate.

4. A first long frame, a second long frame and a mesh plate according to the present invention are integrally formed. An upper surface of the storage mesh plate is smooth and flat, the comfort is stronger, and it is more convenient to load and unload goods.

BRIEF DESCRIPTION OF THE DRAWINGS

To describe the technical solutions in embodiments of the present invention or in the prior art more clearly, the accompanying drawings to be used in the embodiments are briefly introduced below. Apparently, the accompanying drawings in the following description show merely some examples of the present invention, and a person of ordinary skill in the art can still derive other accompanying drawings from these accompanying drawings without inventive efforts.

In the figure.

11. first long frame, 12. second long frame, 13. first short frame, 14. second short frame, 15. mesh plate, 31. first taper sleeve, 32. second taper sleeve, 33. third taper sleeve, 34. fourth taper sleeve, 21. first reinforced protection decorating part, 22. second reinforced protection decorating part, 23. third reinforced protection decorating part, 24. fourth reinforced protection decorating part, 41. first protruding point, 42. second protruding point, 6. second stamping convex edge, 5. first stamping convex edge, 7. reinforcing rib, 16. mesh, 8. first welding spot, 9. second welding spot.

DETAILED DESCRIPTION OF THE INVENTION

The following will clearly and completely describe the technical solutions in the embodiments of the present invention with reference to accompanying drawings in the embodiments of the present invention. Obviously, the described embodiments are some embodiments rather than all embodiments of the present invention. All other embodiments obtained by a person of ordinary skill in the art based on the embodiments of the present invention without creative efforts shall fall within the protection scope of the present invention.

Embodiment 1

Figure 1:
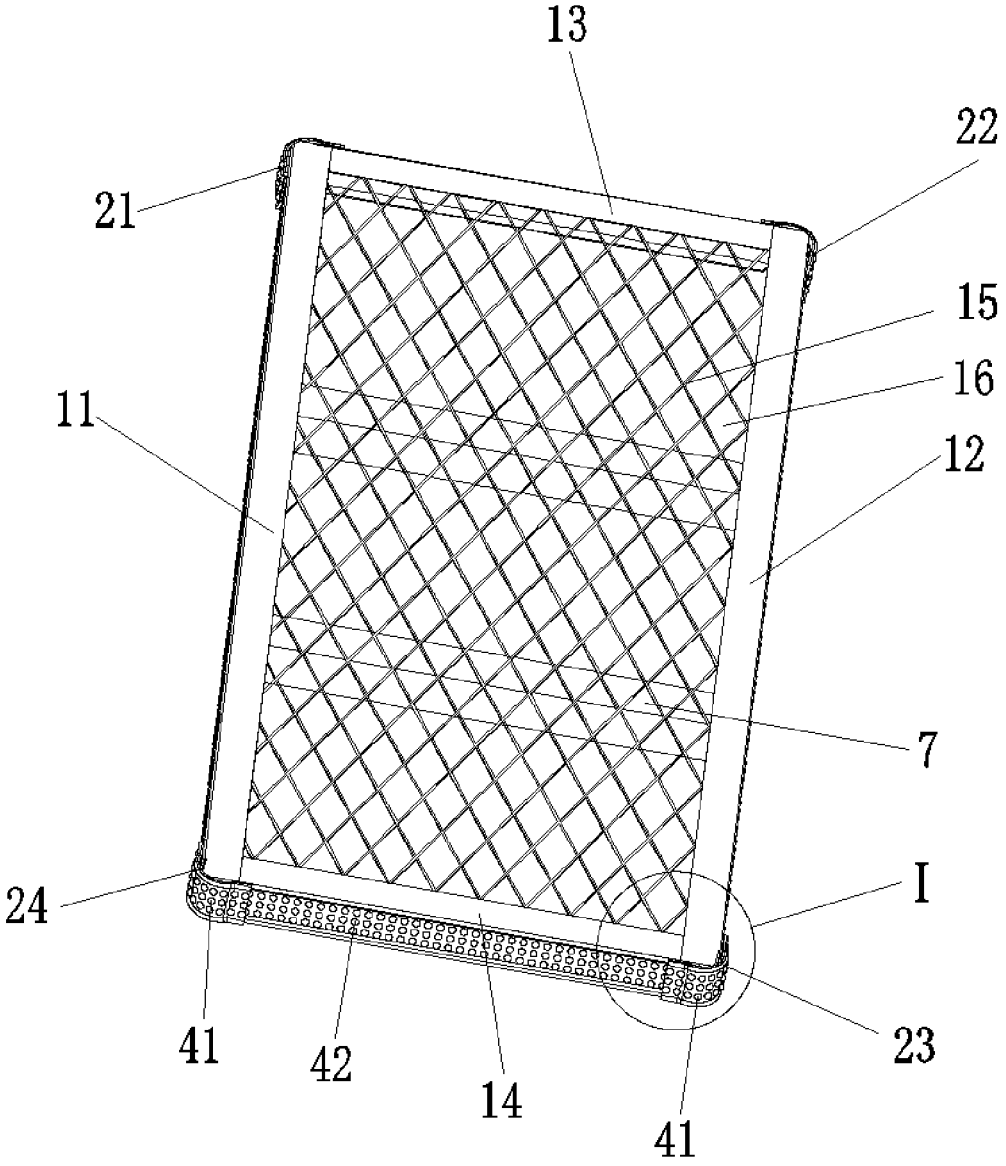
FIG. 1 is a schematic view of a front structure of a storage mesh plate having a reinforced protection and decoration function according to Embodiment 1 of the present invention.
Figure 2:
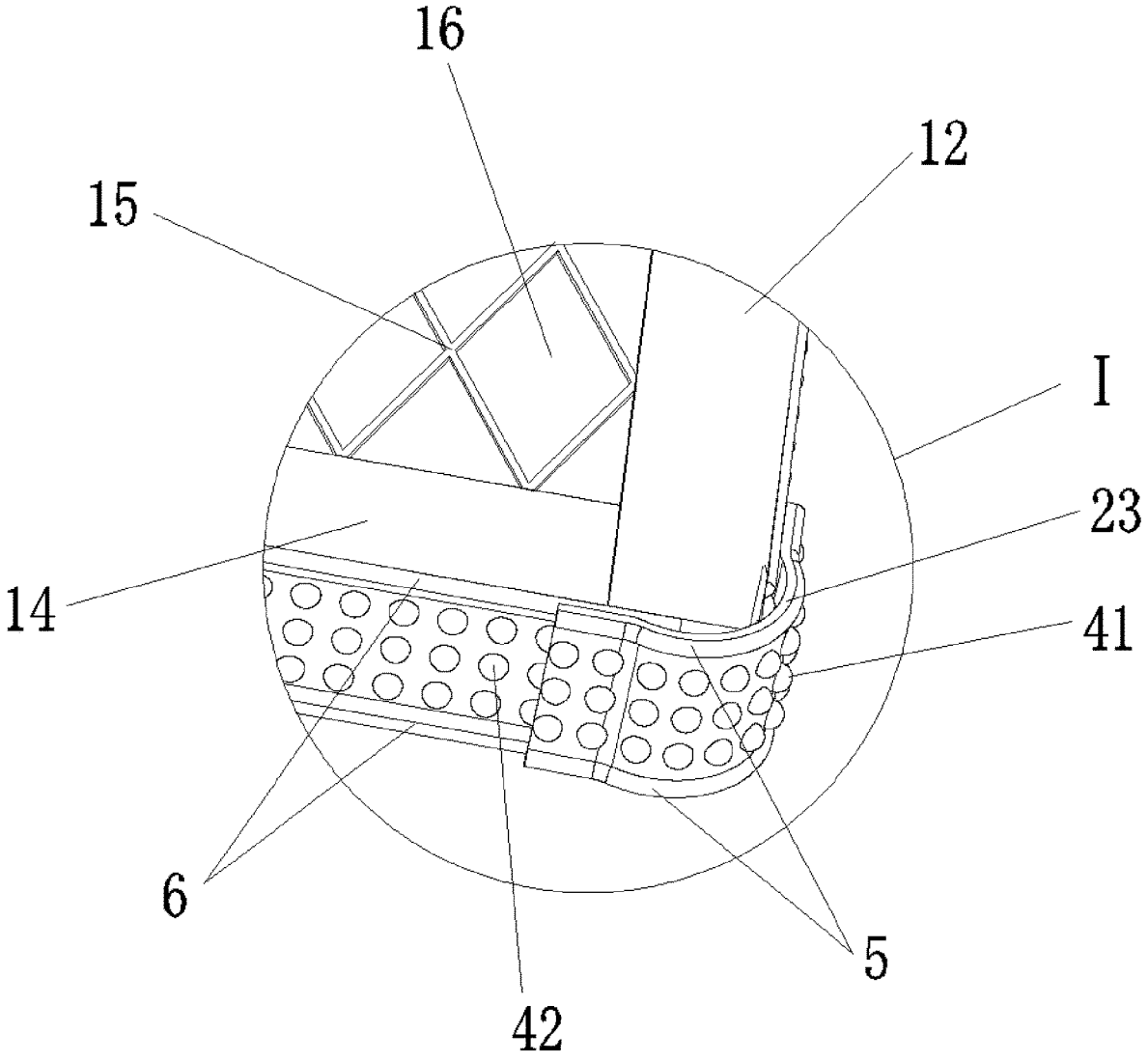
FIG. 2 is an enlarged view of I in FIG. 1.
Figure 3:
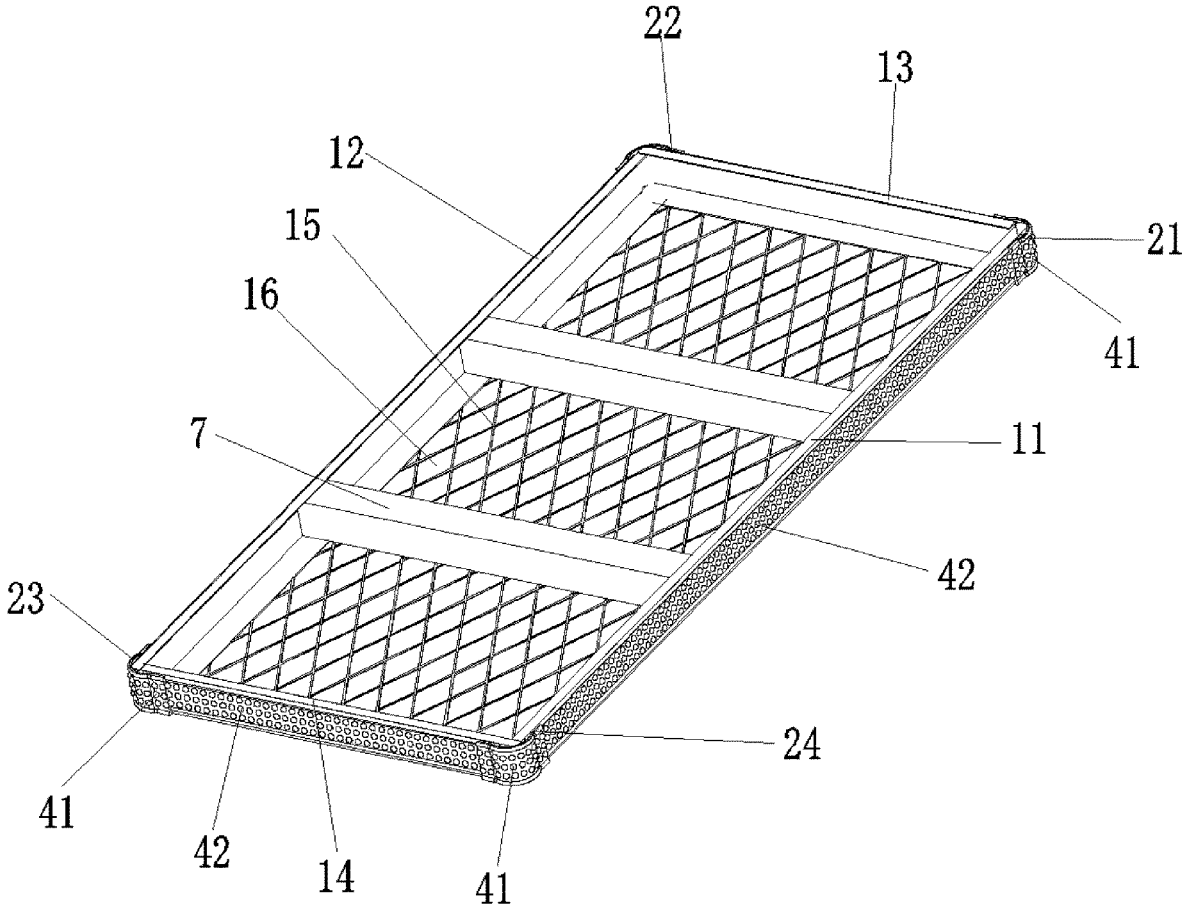
FIG. 3 is a schematic view of a reverse structure of the storage mesh plate having a reinforced protection and decoration function according to Embodiment 1 of the present invention.

Referring to FIGS. 1 to 3, the present invention provides a storage mesh plate having a reinforced protection and decoration function, which includes a first long frame 11 and a second long frame 12, where a mesh plate 15 is arranged on a middle portion of the first long frame 11 and a middle portion of the second long frame 12, and the mesh plate 15 is a metal stretched mesh plate or a metal woven mesh. The metal stretched mesh plate or the metal woven mesh is provided with a plurality of meshes 16, and the meshes 16 are rhombic or in other polygonal shapes. Specifically, the mesh plate 15 is made of metal materials, such as stainless steel and iron. The mesh plate 15 is provided with a plurality of evenly distributed meshes 16, and each mesh 16 passes through the mesh plate 15. Preferably, in this embodiment, the meshes 16 are rhombic. Certainly, according to actual needs, the meshes 16 can also be arranged into different shapes such as a circular shape and a hexagonal shape, which is not limited to this embodiment.

The first long frame 11, the second long frame 12 and the mesh plate 15 are integrally formed by stamping and stretching, so that an upper surface of the storage mesh plate is smooth and flat, the comfort is stronger, and it is more convenient to load and unload goods. One side of the first long frame 11 and one side of the second long frame 12 are provided with a first short frame 13, and the other side of the first long frame 11 and the other side of the second long frame 12 are provided with a second short frame 14. Specifically, the first long frame 11, the second long frame 12 and the mesh plate 15 are integrally formed by stamping and stretching a metal plate or sheet. A middle portion of the plate or the sheet is stretched into the mesh plate 15. Metal straight edges on both sides of the mesh plate 15 are stamped into a first long frame 11 and a second long frame 12. In other embodiments, the first long frame 11, the second long frame 12 and the mesh plate 15 can be integrated by welding, or the first short frame 13, the second short frame 14 and the mesh plate 15 can be integrally formed, or all frames and the mesh plate 15 can be integrated by welding, which is not limited to this embodiment.

A first reinforced protection decorating part 21 is installed at a joint of the first long frame 11 and the first short frame 13, a second reinforced protection decorating part 22 is installed at a joint of the first short frame 13 and the second long frame 12, a third reinforced protection decorating part 23 is installed at a joint of the second long frame 12 and the second short frame 14, and a fourth reinforced protection decorating part 24 is installed at a joint of the second short frame 14 and the first long frame 11. Surfaces of the first reinforced protection decorating part 21, the second reinforced protection decorating part 22, the third reinforced protection decorating part 23 and the fourth reinforced protection decorating part 24 are each provided with a plurality of first protruding points 41 having decorative effects. Four corners of the storage mesh plate are coated for transition, and no sharp corner exists, so that potential safety hazards are eliminated, and the storage mesh plate is elegant in appearance. Surfaces of the decorating parts are provided with protruding points. This has antique decorative effects and classical attractiveness, and greatly improves the purchasing desire of consumers.

Figure 4:
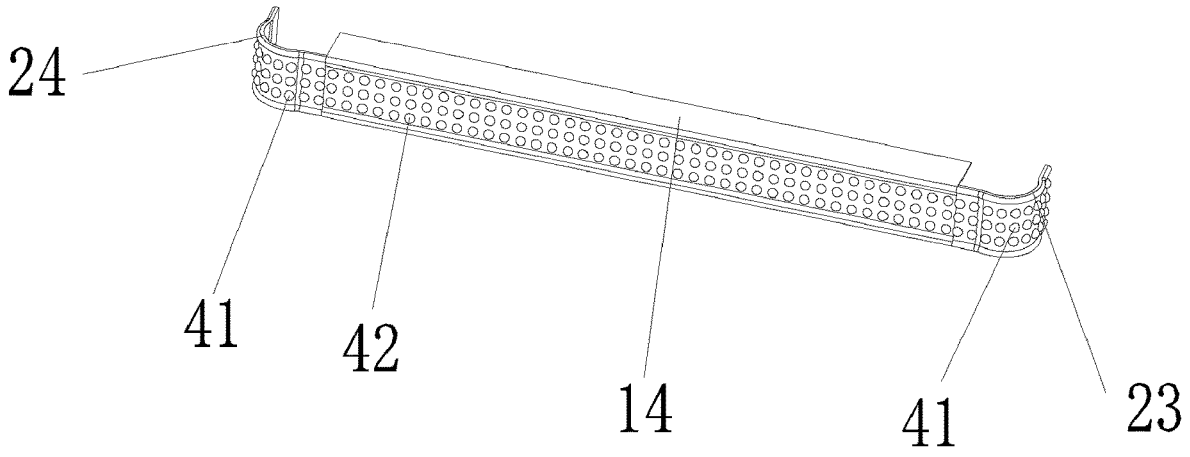
FIG. 4 is a schematic structural view showing that a second short frame is integrally formed with a third reinforced protection decorating part and a fourth reinforced protection decorating part in the storage mesh plate having a reinforced protection and decoration function according to Embodiment 1 of the present invention.

The first short frame 13, the first reinforced protection decorating part 21 and the second reinforced protection decorating part 22 are integrally formed. Referring to FIG. 4, FIG. 4 is a schematic structural view showing that the second short frame 14 is integrally formed with the third reinforced protection decorating part 23 and the fourth reinforced protection decorating part 24. The integral forming manufacturing efficiency is high, material waste and material costs can be reduced, and the surface is attractive.

Embodiment 1 further provides another connection method. As shown in FIGS. 1 and 2, the first reinforced protection decorating part 21 is connected to the surface of the first long frame 11 by welding one end of the first reinforced protection decorating part 21, the other end thereof is connected to the surface of the first short frame 13; the second reinforced protection decorating part 22 is connected to the surface of the first short frame 13 by welding one end of the second reinforced protection decorating part 22, and the other end thereof is connected to the surface of the second long frame 12; the third reinforced protection decorating part 23 is connected to the surface of the second long frame 12 by welding one end of the third reinforced protection decorating part 23, and the other end thereof is connected to the surface of the second short frame 14; the fourth reinforced protection decorating part 24 is connected to the surface of the second short frame 14 by welding one end of the fourth reinforced protection decorating part 24, and the other end thereof is connected to the surface of the first long frame 11. The welding forming process is simple and low in cost, and the storage mesh plate is easy to manufacture.

Upper and lower sides of the first reinforced protection decorating part 21, the second reinforced protection decorating part 22, the third reinforced protection decorating part 23 and the fourth reinforced protection decorating part 24 are provided with first stamping convex edges 5 protruding outwards or have no stamping convex edge. Upper and lower sides of the first long frame 11, the second long frame 12, the first short frame 13 and the second short frame 14 are provided with second stamping convex edges 6 protruding outwards. Smooth side faces of the first long frame 11, the second long frame 12, the first short frame 13 and the second short frame 14 are provided with a plurality of second protruding points 42 having decorative effects. This has antique decorative effects and classical attractiveness. The first stamping convex edges 5 and the second stamping convex edges 6 are installed. This is beneficial to improving the bearing capacity of the storage mesh plate and expands the application range of the storage mesh plate. In order to further strengthen the bearing capacity of the storage mesh plate, the mesh plate 15 is also provided with at least one reinforcing rib 7. One end of the reinforcing rib 7 is welded to the first long frame 11, and the other end thereof is welded to the second long frame 12, or one end of the reinforcing rib 7 is welded to the first short frame 13, and the other end thereof is welded to the second short frame 14. The reinforcing rib 7 is a wire or a pipe.

Figure 5:
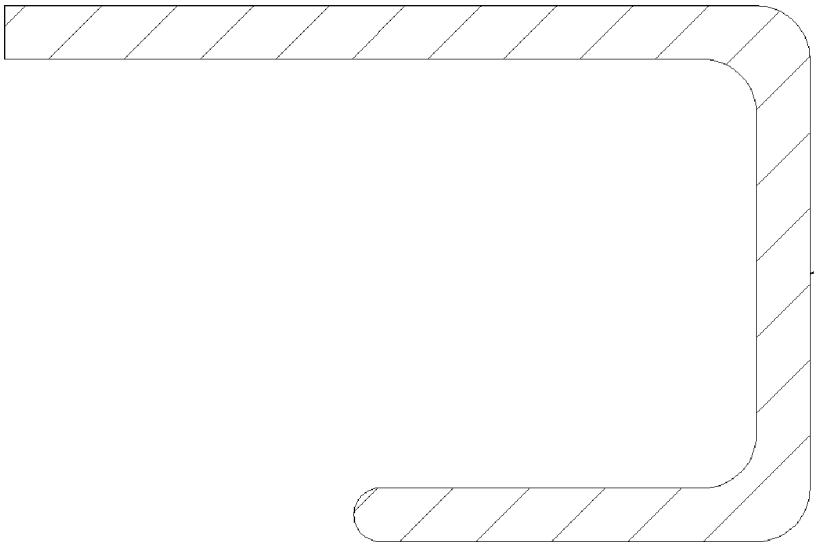
FIG. 5 is a schematic view of a cross-sectional structure of a frame body of the storage mesh plate having a reinforced protection and decoration function according to Embodiment 1 of the present invention.

Referring to FIG. 5, FIG. 5 is a schematic view of a cross-sectional structure of a frame body. The first long frame 11, the second long frame 12, the first short frame 13 and the second short frame 14 each have an L-shaped cross section.

Embodiment 2

Figure 6:
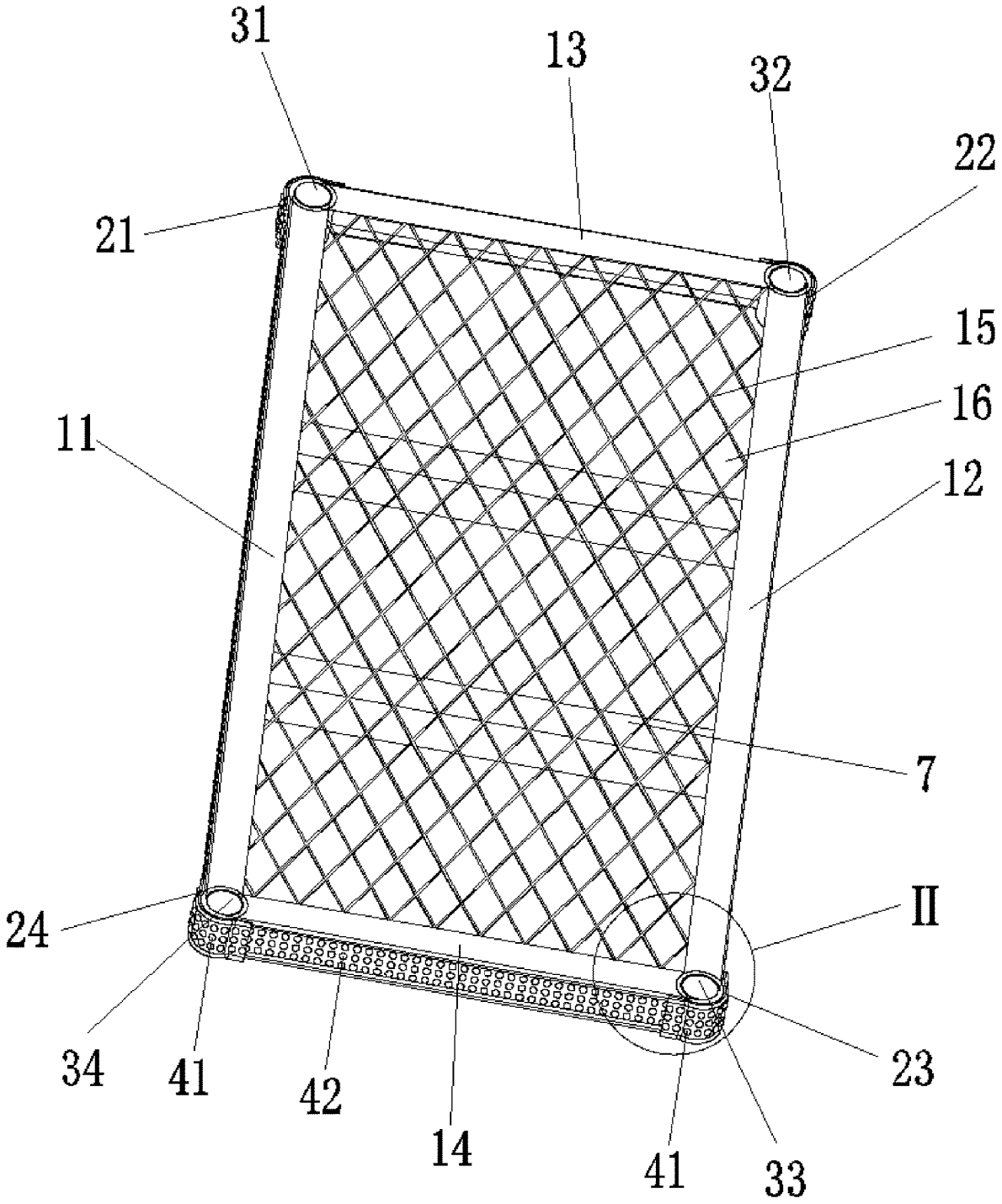
FIG. 6 is a schematic view of a front structure of a storage mesh plate having a reinforced protection and decoration function according to Embodiment 2 of the present invention.
Figure 7:
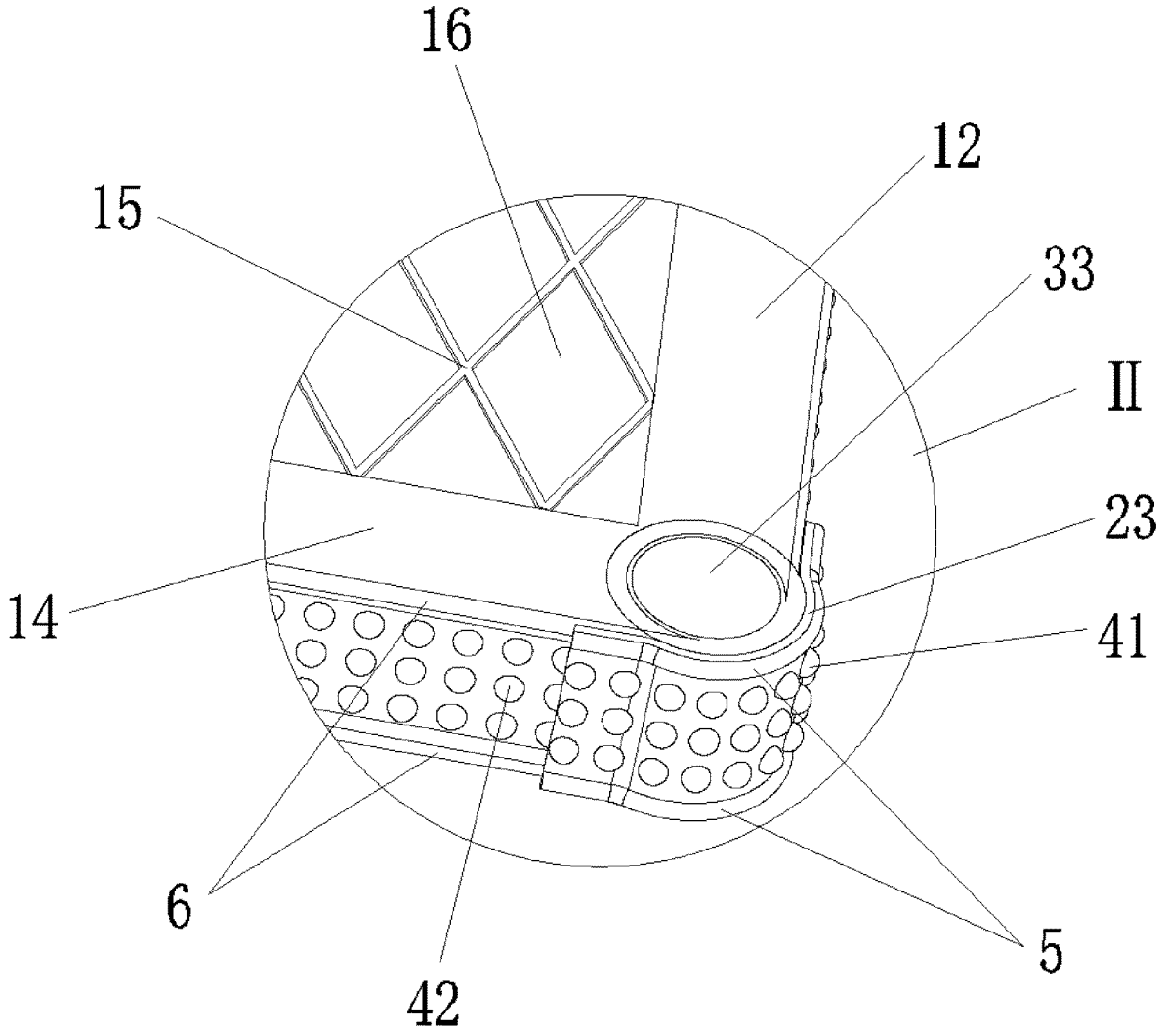
FIG. 7 is an enlarged view of II in FIG. 6.
Figure 8:
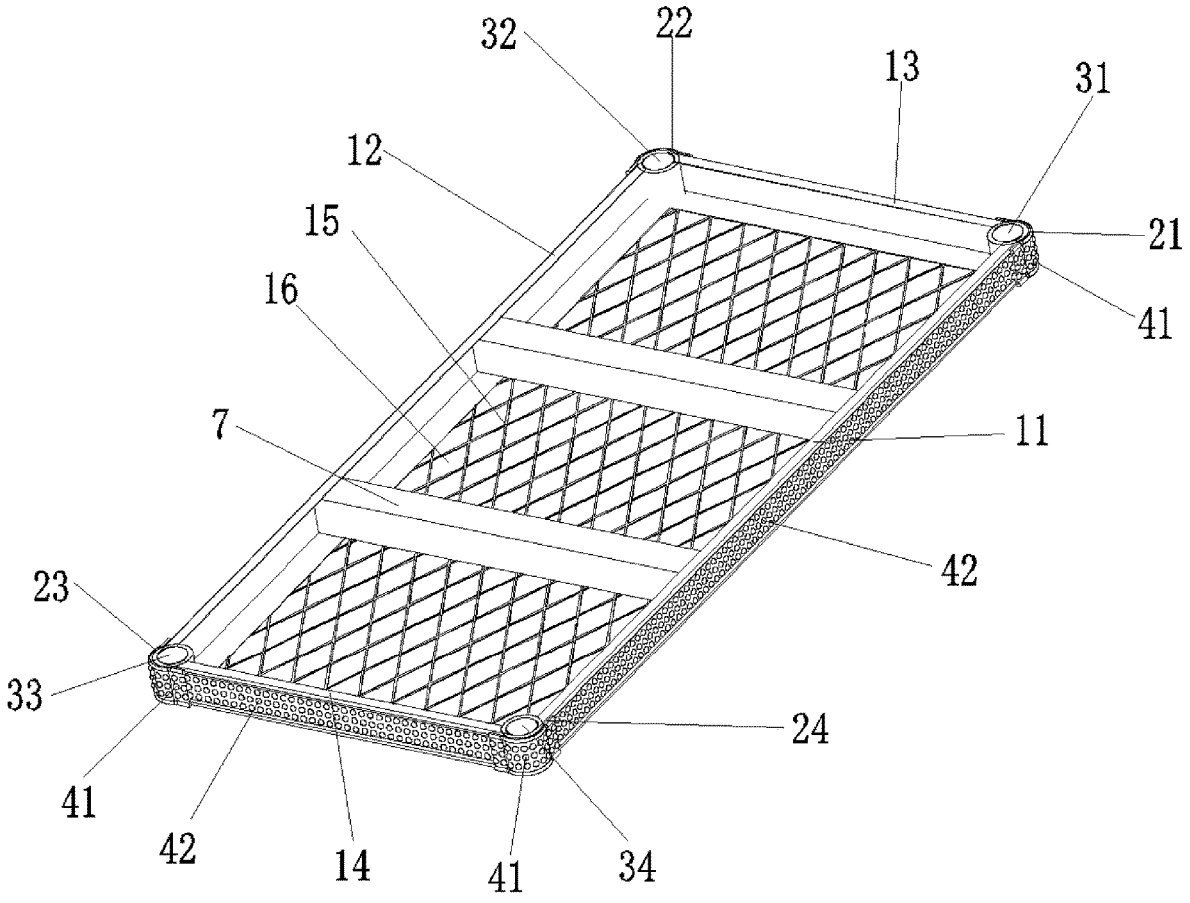
FIG. 8 is a schematic view of a reverse structure of the storage mesh plate having a reinforced protection and decoration function according to Embodiment 2 of the present invention.

Referring to FIGS. 6 to 8, Embodiment 2 of the present invention provides a storage mesh plate having a reinforced protection and decoration function. The structure of the storage mesh plate according to Embodiment 2 is mostly the same as that of the storage mesh plate according to Embodiment 1. The similarities will not be repeated. The differences are as follows: A first taper sleeve 31 is further installed at a joint of the first long frame 11 and the first short frame 13, a second taper sleeve 32 is further installed at a joint of the first short frame 13 and the second long frame 12, a third taper sleeve 33 is further installed at a joint of the second long frame 12 and the second short frame 14, and a fourth taper sleeve 34 is further installed at a joint of the second short frame 14 and the first long frame 11. The taper sleeves are installed at the four corners of the storage mesh plate, which is beneficial to the assembly and adjustment of the storage mesh plate. A circular bracket is inserted in the taper sleeve to form a combined shelf, which is easy to disassemble and assemble quickly.

Figure 9:
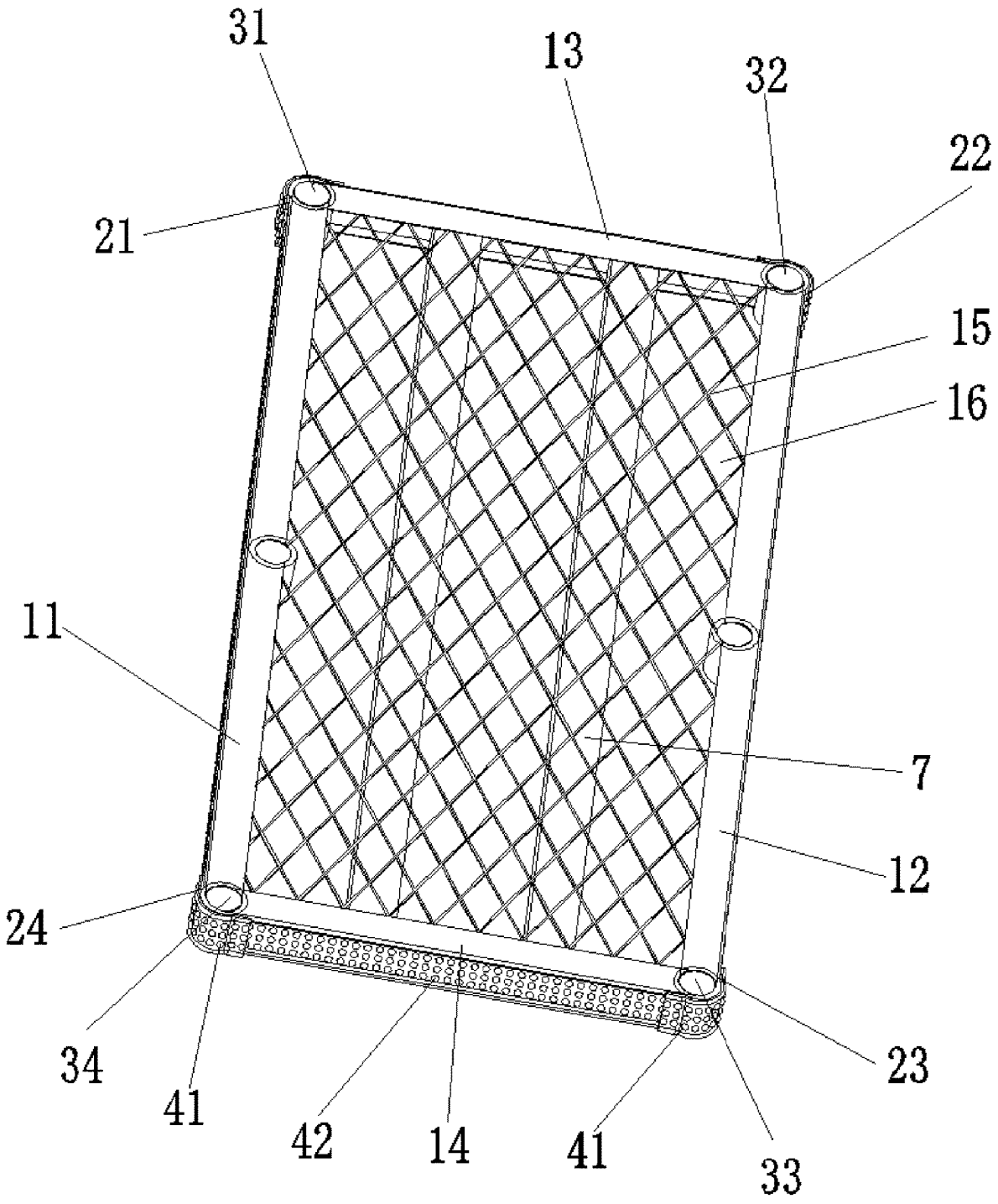
FIG. 9 is a schematic front structural view showing the assembly of reinforcing ribs on short frames in the storage mesh plate having a reinforced protection and decoration function according to Embodiment 2 of the present invention.
Figure 10:
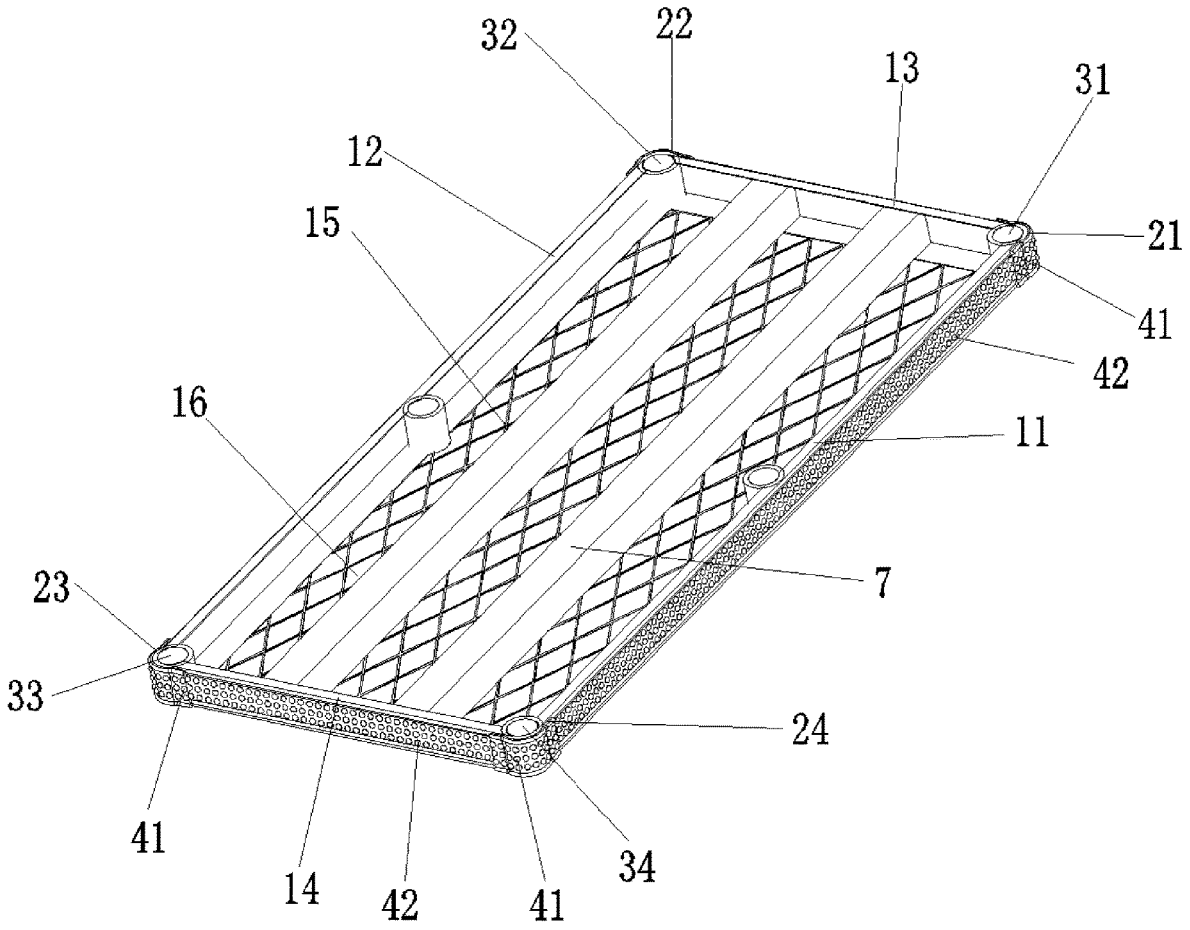
FIG. 10 is a schematic reverse structural view showing the assembly of the reinforcing ribs on the short frames in the storage mesh plate having a reinforced protection and decoration function according to Embodiment 2 of the present invention.

If the first long frame 11 and the second long frame 12 are excessively long, one or more groups of taper sleeves and reinforced protection decorating parts can be installed between the first long frame 11 and the second long frame 12, as shown in FIGS. 9 and 10, to reinforce the strength of the storage mesh plate and the strength of the combined shelf. One end of the reinforcing rib 7 is welded to the first short frame 13, and the other end thereof is welded to the second short frame 14. This is beneficial to further improving the bearing capacity of the storage mesh plate and expands the application range of the storage mesh plate.

The first short frame 13, the first reinforced protection decorating part 21 and the second reinforced protection decorating part 22 are integrally formed. The first reinforced protection decorating part 21 coats the outer surface of the first taper sleeve 31, and the second reinforced protection decorating part 22 coats the outer surface of the second taper sleeve 32. The second short frame 14, the third reinforced protection decorating part 23 and the fourth reinforced protection decorating part 24 are integrally formed. The third reinforced protection decorating part 23 coats the outer surface of the third taper sleeve 33 and the fourth reinforced protection decorating part 24 coats the outer surface of the fourth taper sleeve 34. The integral forming manufacturing efficiency is high, material waste and material costs can be reduced, and the surface is attractive.

Embodiment 2 further provides another connection method. As shown in FIGS. 6 and 7, the first taper sleeve 31 is welded between the first long frame 11 and the first short frame 13, and the first reinforced protection decorating part 21 coats the surface of the first taper sleeve 31 by welding. The second taper sleeve 32 is welded between the first short frame 13 and the second long frame 12. The second reinforced protection decorating part 22 coats the surface of the second taper sleeve 32 by welding, and the third taper sleeve 33 is welded between the second long frame 12 and the second short frame 14. The third reinforced protection decorating part 23 coats the surface of the third taper sleeve 33 by welding. The fourth taper sleeve 34 is welded between the second short frame 14 and the first long frame 11. The fourth reinforced protection decorating part 24 coats the surface of the fourth taper sleeve 34 by welding. The welding forming process is simple and low in cost, and the storage mesh plate is easy to manufacture.

Upper and lower surfaces of the first taper sleeve 31, the second taper sleeve 32, the third taper sleeve 33 and the fourth taper sleeve 34 are parallel to or higher than those of the first long frame 11, the second long frame 12, the first short frame 13 and the second short frame 14.

The first taper sleeve 31, the second taper sleeve 32, the third taper sleeve 33 and the fourth taper sleeve 34 are each in a hollow cone frustum shape; and the first taper sleeve 31, the second taper sleeve 32, the third taper sleeve 33 and the fourth taper sleeve 34 each have a taper of 5-20°. This facilitates quick matching between the storage mesh plate and the circular bracket to form a combined shelf, and facilitates quick disassembly and assembly location of the combined shelf.

Embodiment 3

Figure 11:
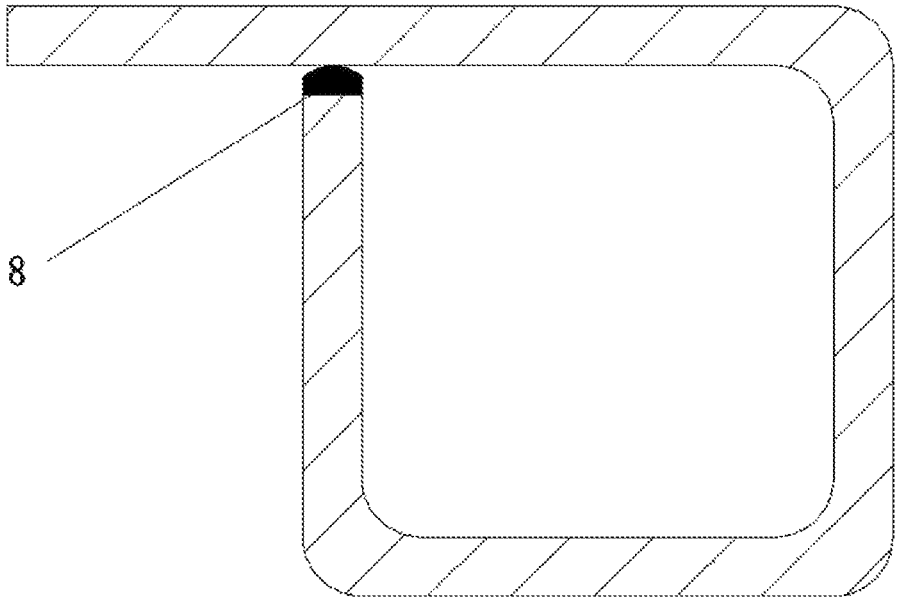
FIG. 11 is a schematic view of a cross-sectional structure of a frame body of a storage mesh plate having a reinforced protection and decoration function according to Embodiment 3 of the present invention.

Referring to FIG. 11, Embodiment 3 of the present invention provides a storage mesh plate having a reinforced protection and decoration function. The structure of the storage mesh plate according to Embodiment 3 is mostly the same as that of the storage mesh plate according to Embodiment 2. The similarities will not be repeated. The difference is that the first long frame 11, the second long frame 12, the first short frame 13 and the second short frame 14 each have a P-shaped cross section. The cross section is provided with a first welding spot 8, and the first welding spot 8 connects the cross section into the P shape.

Embodiment 4

Figure 12:
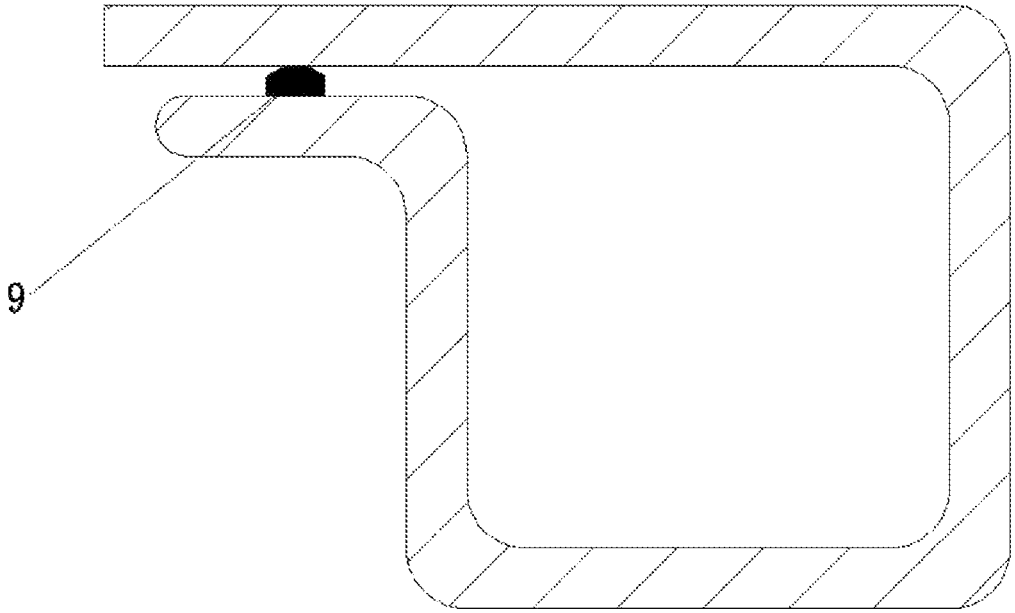
FIG. 12 is a schematic view of a cross-sectional structure of a frame body of a storage mesh plate having a reinforced protection and decoration function according to Embodiment 4 of the present invention.

Referring to FIG. 12, Embodiment 4 of the present invention provides a storage mesh plate having a reinforced protection and decoration function. The structure of the storage mesh plate according to Embodiment 4 is mostly the same as that of the storage mesh plate according to Embodiment 2. The similarities will not be repeated. The difference is that the cross sections of the first long frame 11, the second long frame 12, the first short frame 13 and the second short frame 14 each have a P shape plus a straight edge. The straight edge is provided with a second welding spot 9, and the second welding spot 9 connects the cross section into the P shape.

It should be noted herein that the cross sections of the frames described above may be matched in a mixed mode. Certainly, the cross sections of the frames according to the present invention may also be changed according to actual needs, which is not limited to the foregoing embodiment.

In summary, the present invention has the following beneficial effects:

Four corners of the storage mesh plate according to the present invention are provided with reinforced protection decorating parts and coated for transition, and no sharp corner exists, so that potential safety hazards are eliminated, and the storage mesh plate is elegant in appearance. Surfaces of the reinforced protection decorating parts are provided with a plurality of protruding points 41 having decorative effects, and this has antique decorative effects and classical attractiveness, and greatly improves the purchasing desire of consumers. The four corners of the storage mesh plate according to the present invention are provided with taper sleeves, and this facilitates the assembly and adjustment of the storage mesh plate. The storage mesh plate according to the present invention is provided with first stamping convex edges 5, second stamping convex edges 6 and reinforcing ribs 7, and this is beneficial to improving the bearing capacity of the storage mesh plate and expands the application range of the storage mesh plate. A first long frame 11, a second long frame 12 and a mesh plate 15 according to the present invention are integrally formed. An upper surface of the storage mesh plate is smooth and flat, the comfort is stronger, and it is more convenient to load and unload goods.

The foregoing embodiments are preferred embodiments of the present invention. However, the embodiments of the present invention are not limited by the foregoing embodiments. Any other changes, modifications, replacements, combinations and simplifications made without departing from the spirit and principle of the present invention should all be equivalent replacement manners, and shall fall within the protection scope of the present invention.

What is claimed is:

1. A storage mesh plate having a reinforced protection and decoration function, comprising a first long frame (11) and a second long frame (12), wherein a mesh plate (15) is arranged on a middle portion of the first long frame (11) and a middle portion of the second long frame (12); the first long frame (11), the second long frame (12) and the mesh plate (15) are integrally formed by stamping and stretching; one end of the first long frame (11) and one end of the second long frame (12) are provided with a first short frame (13), and the other end of the first long frame (11) and the other end of the second long frame (12) are provided with a second short frame (14); four corners where the first long frame (11) is connected to the first short frame (13) and the second short frame (14) and the second long frame (12) is connected to the first short frame (13) and the second short frame (14) are provided with a first reinforced protection decorating part (21), a fourth reinforced protection decorating part (24), a second reinforced protection decorating part (22) and a third reinforced protection decorating part (23) respectively; the first short frame (13), the first reinforced protection decorating part (21) and the second reinforced protection decorating part (22) are installed together by welding or integrally formed; and the second short frame (14), the third reinforced protection decorating part (23) and the fourth reinforced protection decorating part (24) are installed together by welding or integrally formed;

wherein surfaces of the first reinforced protection decorating part (21), the second reinforced protection decorating part (22), the third reinforced protection decorating part (23) and the fourth reinforced protection decorating part (24) are each provided with a plurality of first protruding points (41) having decorative effects, and upper and lower sides of the first reinforced protection decorating part (21), the second reinforced protection decorating part (22), the third reinforced protection decorating part (23) and the fourth reinforced protection decorating part (24) are provided with first stamping convex edges (5) protruding outwards.

2. The storage mesh plate having a reinforced protection and decoration function according to claim 1, wherein a first taper sleeve (31) is further installed at a joint of the first long frame (11) and the first short frame (13), a second taper sleeve (32) is further installed at a joint of the first short frame (13) and the second long frame (12), a third taper sleeve (33) is further installed at a joint of the second long frame (12) and the second short frame (14), a fourth taper sleeve (34) is further installed at a joint of the second short frame (14) and the first long frame (11), an outer side of the first taper sleeve (31) is coated with the first reinforced protection decorating part (21), an outer side of the second taper sleeve (32) is coated with the second reinforced protection decorating part (22), an outer side of the third taper sleeve (33) is coated with the third reinforced protection decorating part (23), and an outer side of the fourth taper sleeve (34) is coated with the fourth reinforced protection decorating part (24).

3. The storage mesh plate having a reinforced protection and decoration function according to claim 1, wherein outer side of the first long frame (11), the second long frame (12), the first short frame (13) and the second short frame (14) are provided with second stamping convex edges (6) protruding outwards, and side faces of the first long frame (11), the second long frame (12), the first short frame (13) and the second short frame (14) are provided with a plurality of second protruding points (42) having decorative effects.

4. The storage mesh plate having a reinforced protection and decoration function according to claim 1, wherein the mesh plate (15) is also provided with at least one reinforcing rib (7), one end of the reinforcing rib (7) is welded to the first long frame (11), and the other end thereof is welded to the second long frame (12), or one end of the reinforcing rib (7) is welded to the first short frame (13), the other end thereof is welded to the second short frame (14), and the reinforcing rib (7) is a wire or a pipe.

5. The storage mesh plate having a reinforced protection and decoration function according to claim 2, wherein upper and lower surfaces of the first taper sleeve (31), the second taper sleeve (32), the third taper sleeve (33) and the fourth taper sleeve (34) are parallel to or higher than those of the first long frame (11), the second long frame (12), the first short frame (13) and the second short frame (14).

6. The storage mesh plate having a reinforced protection and decoration function according to claim 2, wherein the first taper sleeve (31), the second taper sleeve (32), the third taper sleeve (33) and the fourth taper sleeve (34) are each in a hollow cone frustum shape; and the first taper sleeve (31), the second taper sleeve (32), the third taper sleeve (33) and the fourth taper sleeve (34) each have a taper of 5-20°.

7. The storage mesh plate having a reinforced protection and decoration function according to claim 1, wherein the mesh plate (15) is a metal stretched mesh plate or a metal woven mesh, the metal stretched mesh plate or the metal woven mesh is provided with a plurality of meshes (16), and the meshes (16) are rhombic or in other polygonal shapes.

8. The storage mesh plate having a reinforced protection and decoration function according to claim 1, wherein cross sections of the first long frame (11), the second long frame (12), the first short frame (13) and the second short frame (14) are each in an L shape, a P shape or a P shape plus a straight edge.

* * * * *